United States Patent [19]

Hafner et al.

[11] Patent Number: 4,471,914

[45] Date of Patent: Sep. 18, 1984

[54] ELECTROMAGNETICALLY ACTUATABLE VALVE

[75] Inventors: Udo Hafner, Lorch; Rudolf Krauss, Stuttgart; Hans Kubach, Korntal; Rudolf Sauer, Benningen, all of Fed. Rep. of Germany

[73] Assignee: Robert Bosch GmbH, Stuttgart, Fed. Rep. of Germany

[21] Appl. No.: 417,973

[22] Filed: Sep. 14, 1982

[30] Foreign Application Priority Data

Mar. 5, 1982 [DE] Fed. Rep. of Germany ..... 3207918

[51] Int. Cl.[3] ..... F02M 51/08

[52] U.S. Cl. ..... 239/585; 251/141

[58] Field of Search ..... 239/585; 251/141

[56] References Cited

U.S. PATENT DOCUMENTS 2,881,980 4/1959 Beck et al. ..... 239/585 X 3,001,757 7/1961 Ball ..... 239/585

4,416,423 11/1983 Krauss et al. ..... 239/585

*Primary Examiner*—Andres Kashnikow

*Attorney, Agent, or Firm*—Edwin E. Greigg

[57] ABSTRACT

An electromagnetically actuatable valve, in particular a fuel injection valve for fuel injection systems. The valve includes a valve housing of ferromagnetic material and a core on which a magnetic coil is placed. An intermediate disk of ferromagnetic material is disposed on the end face of the cup-like valve housing. The passage bore has a lesser diameter than the inner bore of the valve housing. A flat armature partially protrudes beyond the stop face of the intermediate disk remote from the valve housing and again has a smaller diameter than the inner bore of the valve housing. Because of the small diameter of the flat armature, the flat armature has a small mass, so that short switching times of the valve are attainable.

8 Claims, 3 Drawing Figures

111
112
103
16
49
115
88
86
113
114
116
55
1
53
12
108
87
54
109
104
47
48
29
35
85
57
13
42
106
107
46
27
105
95
56
38
44
36
92
97
96
45
25
40
101
58
41
99
65
26
98
102
89
93
91
59
120
60
37
II
50
118
78
84
119
61
II
51
81
63
79
77
79
83
82
62
80
75
14
74
73
72
94
76
64
117
69
68
66
8
71
67

ELECTROMAGNETICALLY ACTUATABLE VALVE

BACKGROUND OF THE INVENTION

The invention is based on an electromagnetically actuatable valve as set forth herein. It has already been proposed in an electromagnetically actuatable valve to embody the valve housing of ferromagnetic material and to make the flat armature so large that it partially protrudes beyond the end face of the valve housing. However, this produces the disadvantage that the flat armature becomes quite large and thus very heavy, prolonging the switch times of the valve in an undesirable manner.

OBJECT AND SUMMARY OF THE INVENTION

The valve according to the invention has the advantage over the prior art that the weight of the flat armature is reduced, thus shortening the switching times of the valve.

By means of the characteristics disclosed, advantageous further developments of and improvements to the valves disclosed can be attained. It is particularly advantageous to guide the flat armature with a guide diaphragm in the axial and radial direction, and to provide support points by means of stamping in the vicinity of the outer circumference of the flat armature for the sake of the axial guidance, thus improving the ridigity and the manufacture of the flat armature. It is furthermore advantageous to perform the axial and radial guidance of the flat armature by means of only one guide region on one guide diaphragm, as close as possible to the outer circumference of the flat armature, so that the guidance becomes more precise.

It is also advantageous to weld the intermediate disk to the valve housing and to temper it in an area at which the flat armature comes to rest.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
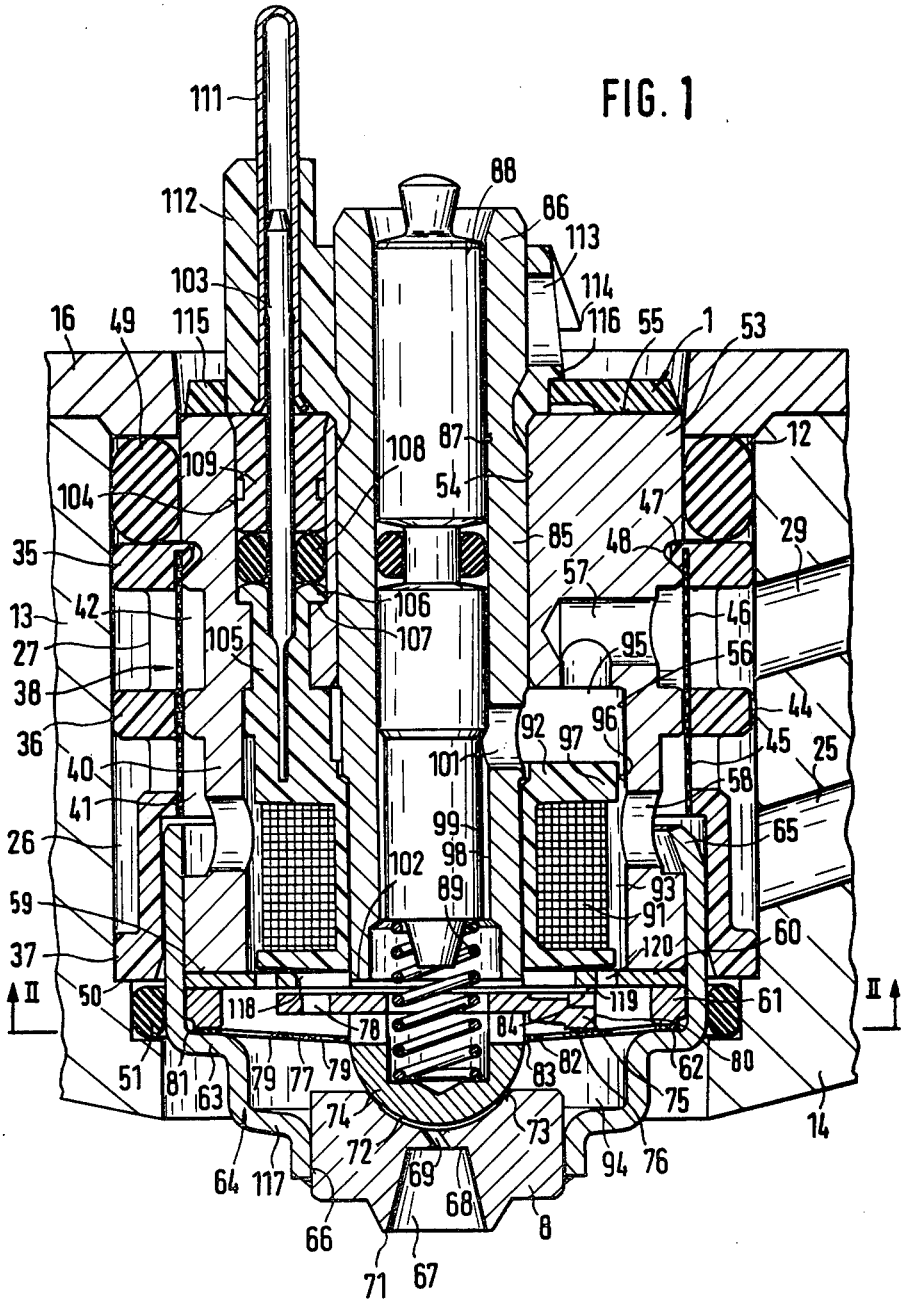
FIG. 1 shows a first exemplary embodiment of an electromagnetically actuatable valve.

The fuel injection valve 1 of a fuel injection system for internal combustion engines, which is shown as an example of an electromagnetically actuatable valve in FIG. 1, is guided in the radial direction in a guide opening 12 of a holder body 13 by means of elastic support bodies 35, 36, 37 of a fuel filter 38, which extends in the axial direction, overlapping the mouth of a fuel supply line 25 and the mouth of a fuel outflow line 29. In the axial direction, a circumferential groove 27 is defined by the support bodies 35 and 36, while a circumferential groove 26 is defiend by the support bodies 36 and 37. The support bodies 35, 36, 37 are fabricated of some elastic material such as rubber or plastic. The middle support body 36 in particular is embodied annularly such that it is supported on the circumference of the valve housing 40 between a fuel supply groove 41 and a fuel outflow groove 42 on one side and on the guide opening 12 on the other in such a manner that this support body 36 seals off the fuel supply groove 41 and the fuel supply line 25 including the circumferential groove 26 from the fuel outflow groove 42 and the fuel outflow line 29 including the circumferential groove 27. In order to be able to carry away any vapor bubbles which may be contained in the fuel, a throttling degassing conduit 44 is provided between the circumference of the middle support body 36 and the wall of the guide opening 12; the degassing conduit 44 permits scavenging of vapor bubbles out of the circumferential groove 26 toward the circumferential groove 27 and extends over only a limited length of the middle support body 36. Although it is not shown in such a fashion, the degassing conduit could also be embodied in the wall of the guide opening 12 or between the circumference of the valve housing 40 and the middle support body 36. The fuel flowing in via the fuel supply line 25 first reaches the circumferential groove 26 and then flows via a filter area 45 into the fuel supply groove 41 embodied on the valve housing 40. From the fuel outflow groove 42 likewise embodied on the valve housing 40, the fuel flows via a filter area 46 into the circumferential groove 27 and from there into the fuel flow outflow line 29. Dirt particles which may be contained in the fuel are filtered out by the filter areas 45, 46. The upper support body 35 may be provided on its side oriented toward the valve housing 40 with a detent protrusion 47, which when the fuel filter 38 is pushed onto the valve housing 40 finds a detent in a detent groove 48 of the valve housing, so that the fuel injection valve 1 can be inserted together with the mounted fuel filter into the guide opening 12 of the holder body 13. A sealing ring 49 may be axially supported on the upper support body 35, being disposed between the valve housing 40 and the holder body 13 and fixed at the other end by a cap 16. The axial position of the fuel injection valve is furthermore determined in that the lower support body 37 is supported on a step 50 of the guide opening 12. A further sealing ring 51 is disposed near the lower support body 37 at the circumference of the fuel injection valve 1.

The valve housing 40 is cup-like in shape and has a through bore 54 in the housing bottom 53, leading from the outer end face 55 to an inner bore 56. From the inner bore 56, at least one fuel outflow opening 56 leads through the wall of the valve housing 40 to the fuel outflow groove 42 and at least one fuel supply opening 58 leads to the fuel supply groove 41. A ferromagnetic intermediate disk 60 rests on the end face 59 remote from the housing bottom 53, and a spacer ring 61 which is adjoined by a guide diaphragm 62 rests on the intermediate disk 60. The intermediate disk 60 is advantageously welded to the end face 59 of the ferromagnetic valve housing 40. The other side of the guide diaphragm 62 is engaged by a collar 63 of a nozzle carrier 64, which partially surrounds and engages the valve housing 40 and is crimped into the fuel supply groove 41 with its end 65, thus effecting an axial tensioning force for the purpose of positional fixation of the spacer ring 61 and the guide diaphragm 62. Remote from the valve housing 40, the nozzle carrier 64 forms a coaxial reception bore 66, in which a nozzle body 8 is inserted and is secured, for instance by welding and soldering.

The nozzle body 8 has a preparation bore 67, embodied as a truncated cone for example, and at least one fuel guide bore 69 serving to meter fuel discharges at the bottom 68 of this preparation bore 67. The fuel guide bore 69 discharges at the bottom 68 in such a manner that a tangentially directed inflow into the preparation bore 67 is not effected., instead, the fuel stream at first exits freely from the fuel guide bore 69 without touching the wall, and subsequently strikes against the wall of the preparation bore 67, then distributing itself in a filmlike manner over this wall, flowing approximately in the form of a parabola toward the end 71 of the bore 67 and tearing off there. The fuel guide bores 69 extend at an inclination relative to the valve axis and begin at a concave chamber 72 formed in the nozzle body 8, upstream of which a curved valve seat 73 is formed in the nozzle body 8, with which a ball-like valve element 74 cooperates. In order to attain the smallest possible dead space, the volume of the concave chamber 72 should be as small as possible when the valve element 74 is resting on the valve seat 73.

Remote from the valve seat 73, the valve element 74 is connected with a flat armature 75, being welded or soldered by way of example. The flat armature 75 may be embodied as a stamped or cast element and has support points 76 which are embodied in a raised fashion by means of stamping near the outer circumference 80 of the flat armature 75 and rest on an annular guide area 77 of the guide diaphragm 62 on the side of the guide diaphragm 62 remote from the valve seat 73. Passageway openings 78 in the flat armature 75 and flow recesses 79 in the guide diaphragm 62 permit an unhindered flow of fuel around the flat armature 75 and the guide diaphragm 72. The guide diaphragm 62 fastened at its outer circumference in a clamping region 81 integral with the housing between the spacer ring 61 and the collar 63 has a centering area 82, which encloses a centering opening 83 through which the movable valve element 74 protrudes and is thus centered in the radial direction. The clamping of the guide diaphragm 62 integral with the housing between the spacer ring 61 and the collar 63 is effected in a plane which, when the valve element 74 is resting on the valve seat 73, extends through the center or as close as possible to the center of the spherical valve element. The flat armature 75 is guided as nearly parallel as possible to the intermediate disk 60 by means of the guide area 77 of the guide diaphragm 62 engaging the support points 76 of the flat armature 75., the flat armature 75 partially protrudes with an outer effective area 84 beyond the intermediate disk 60.

A tubular core 85 is inserted into the passage bore 54 of the housing bottom 53, extending at one end almost as far as the flat armature 75 and at the other end, forming the end 86 of a fitting, protruding outside the valve housing. A slide member 88 is pressed or threaded into a bearing bore 87 of the core 85, and a compression spring 89 is supported on the slide member 88 and at the other end engages the valve element 74 and tends to urge the valve element 74 toward the valve seat 73. An insulating carrier body 92 carrying a magnetic coil 91 is disposed on the core 85 in the inner bore 56 of the valve housing 40. The fuel flowing via the fuel inflow openings 58 approximately at the level of the carrier body 92 flows into a flow chamber 93 formed between the circumference of the magnetic coil 91 and of the carrier body 92 and the inner bore 56, and from there flows in an unthrottled manner to a collector chamber 94 surrounding the valve seat 73 and the valve element 74. Remote from the flat armature 75, the carrier body 92 and the housing bottom 53 define an outflow chamber 95, with which the flow chamber 93 communicates the first throttle restriction 96. The first throttle restriction 96 may advantageously be embodied by the annular gap between the circumference of one side 97 of the carrier body 92 and the wall of the inner bore 56. The first throttle restriction 96 could, however, also be embodied directly in the wall of the inner bore 56 or in the side 97. The arrangement of the first throttle restriction 96 offers the advantage that vapor bubbles which collect in the flow chamber 94 can pass directly into the outflow chamber 95, without previously being carried through the flowing fuel in the collector chamber 94. The outflow chamber 95 communicates with the fuel outflow openings 56, so that vapor bubbles are scavenged out of the outflow chamber 95 along with the fuel flowing back into the fuel outflow line 99.

An annular second throttle restriction 98 is embodied between the circumference of a slide member area 99 oriented toward the flat armature and the wall of the bearing bore 87 of the core 85, likewise communicating with the outflow chamber via at least one radial bore 101 and making it possible for vapor bubbles existing in the vicinity of the valve element 74 likewise to be scavenged out toward the fuel outflow line 29.

The core 85 is advantageously pushed into the valve housing 40 to such an extent that only a small air gap is provided between its end face 102 oriented toward the flat armature 75 and the flat armature 75 itself, if when the magnetic coil 91 is excited the flat armature comes to rest with its outer effective area 84 on the intermediate disk 60, while when the magnetic coil 91 is not excited the flat armature assumes a position in which again an air gap is formed between the intermediate disk 60 and the effective area 84. The flat armature is thereby prevented from sticking to the core. After the establishment of the required air gap, the core 85 is advantageously soldered or welded to the housing bottom 53. The magnetic circuit extends at the outside via the valve housing 40 and on the inside via the core 85 and is closed via the intermediate disk 60 and the flat armature 75. While the core 85 and the flat armature 75 may be of valuable soft-magnetic material, the valve housing 40 may also be fabricated of less expensive material, for instance free-cutting steel, the exertion of force upon the flat armature 75 is effected predominantly via the core 85 when the magnetic coil 91 is excited.

The supply of current to the magnetic coil 91 is effected via contact lugs 103, which are partly injected into the carrier body 92 formed of plastic and at the other end protrude from the housing bottom 53 via connection openings 104 in the housing bottom 53. The carrier body 92 may have holder extensions 105, each partially surrounding one contact lug and protruding into the connection opening 104, where by means of an annular hot riveting 106 at an extension 107 they can be fixed in the connection openings 104 in the axial direction. For sealing purposes, a sealing ring 108 is disposed surrounding and engaging the contact lug 103 in the connection opening 104, and adjacent thereto is a bushing 109. In order to attain standardized plug connections, a contact sheath 111 is placed on each contact lug 103 protruding out of the valve housing 40 and welded or soldered thereto. As a result, the diameter of the contact lugs 103 can be kept small, resulting in smaller connection openings 104 which are more easily sealed off. The contact sheaths 111 and the end 86 of the fitting may subsequently have a sprayed plastic coating 112 disposed partially around them, while opposite therefrom at the fitting end 86, two bores 113 remain cut out of the plastic coating 112, serving as access for a tool in order to squeeze the fitting end in the radial direction; subsequently the slide member 88 is pushed so far within the guide bore 87 that the force of the compression spring 89 is pre-stressed in a desired manner. As a result, the dynamic fuel injection quantity is fixed. A protrusion 114 on the plastic coating may serve by way of example as a detent means of an electric plug (not shown), which serves to provide electrical contact between the contact sheaths 111 and an electronic control unit. A plastic disk 115 may be pushed onto the plastic coating 112, resting on the end face 55 of the housing bottom 53 and being locked in by a detent protrusion 116 on the plastic coating 112. The plastic disk serves to identify the type of fuel injection valve involved; different colors of the plastic disk or specific data disposed on the surface of the plastic disk can serve to perform this identification. In order to establish the static flow-through quantity, the nozzle carrier 64 may have a deformation zone 117, which is plastically deformable in the axial direction of the valve; as a result, the nozzle body 8 can be displaced to a greater or lesser extent together with the valve seat 73 in the direction toward the valve element 74. The intermediate disk 60 disposed in accordance with the invention on the end face 59 of the valve housing 40 has a passage bore 118, the diameter of which is smaller than the diameter of the inner bore 56 of the valve housing 40, but greater than that of the core 85. As a result, the flat armature 75 as well can be kept small in terms of its outer circumference, as a result of which the flat armature 75 has little mass and thus assures short switching times. The stop face 119 of the of the intermediate disk 60 associated with the effective area 84 or the flat armature 75 is tempered to a depth of approximately 0.1 mm, as a result of which wear is substantially reduced yet the values of the magnetic circuit are affected only insignificantly. Flow openings 120 permit unhindered flow around the intermediate disk 60 from the flow chamber 93 to the collector chamber 94.

Figure 2:
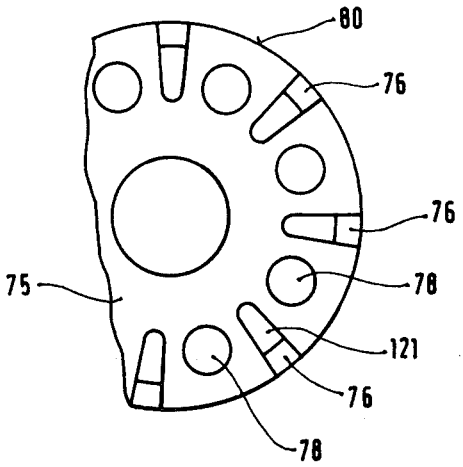
FIG. 2 is a section taken along the line II—II of FIG. 1.

The flat armature 75 of FIG. 1, shown only partially in plan view in FIG. 2, has stamped support points 76 in the vicinity of the outer circumference 80, which are raised in the direction toward the valve seat 73, being distributed at equal intervals and supported on the guide area 77 of the guide diaphragm 62. Reinforcement ribs 121, which are also stamped in at the same time increase the stability of the flat armature 75. The flowthrough openings 78 are provided between the reinforcement ribs 121 or in other words between the support points 76.

Figure 3:
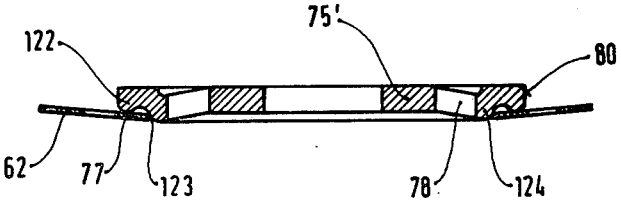
FIG. 3 shows a further form of embodiment of a flat armature.

In the exemplary embodiment shown in FIG. 3 of a flat armature 75', which may be disposed in the fuel injection valve 1 of FIG. 1 instead of the flat armature 75, a concentric guide ring 122 embodied near the outer circumference 80 of the flat armature 75' is seated on the guide area 77 of the guide diaphragm 62 clamped attached to the housing, and is thus guided in the axial direction parallel to the intermediate disk 60. A centering opening 123 of the guide area 77 of the guide diaphragm 62 surrounds and engages a concentric, annular step 124, which is embodied by chip-free shaping on the flat armature 75' and thus guides the flat armature 75 in a radial direction.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An electromagnetically actuatable valve for fuel injection systems of internal combustion engines, comprising a valve housing of ferromagnetic material having an inner bore, a core of ferromagnetic material, a magnetic coil attached to said core actuating a valve element cooperating with a valve seat, a flat armature which activates said valve element, an intermediate disk of ferromagnetic material disposed on an end face of said valve housing oriented toward said flat armature, a stop face on said intermediate disk, and a passage bore in said intermediate disk, said flat armature having a smaller diameter than said inner bore of said valve housing and said flat armature partially protrudes beyond said stop face on said intermediate disk remote from said valve housing, a guide diaphragm clamped to said housing, said guide diaphragm resting on support points on said flat armature on a side of said flat armature and oriented toward said valve seat under spring tension, for the purpose of parallel guidance with respect to said intermediate disk, and said support points are formed by means of stamping in an axial direction near the outer circumference of said flat armature.

2. A valve as defined by claim 1, in which said guide diaphragm has a central guide opening which surrounds and engages a valve element and guides both said valve element and said flat armature in a radial direction.

3. A valve as defined by claim 2, in which said guide diaphragm is provided, with a guide zone upon which rests a concentric guide ring near the outer circumference of said flat armature, under the influence of spring tension, and guides said flat armature parallel to said intermediate disk, and the guide zone has a centering opening which surrounds and engages a concentric step of the flat armature for the sake of radial guidance.

4. A valve as defined by claim 1, in which said intermediate disk is welded to the valve housing.

5. A valve as set forth in claim 1, characterized in that the intermediate disk is tempered in the vicinity of a zone at which the flat armature comes to rest when the magnetic coil is excited.

6. A valve as set forth in claim 2, characterized in that the intermediate disk is tempered in the vicinity of a zone at which the flat armature comes to rest when the magnetic coil is excited.

7. A valve as set forth in claim 3, characterized in that the intermediate disk is tempered in the vicinity of a zone at which the flat armature comes to rest when the magnetic coil is excited.

8. A valve as set forth in claim 4, characterized in that the intermediate disk is tempered in the vicinity of a zone at which the flat armature comes to rest when the magnetic coil is excited.

* * * * *